US007066126B2

(12) United States Patent
Tokuyasu et al.

(10) Patent No.: US 7,066,126 B2
(45) Date of Patent: Jun. 27, 2006

(54) FUEL SUPPLY SYSTEM AND METHOD OF DIRECT FUEL INJECTION ENGINE

(75) Inventors: Noboru Tokuyasu, Tokyo (JP); Toshiharu Nogi, Tokyo (JP); Takashi Yoshida, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/827,439

(22) Filed: Apr. 20, 2004

(65) Prior Publication Data

US 2004/0206337 A1 Oct. 21, 2004

(30) Foreign Application Priority Data

Apr. 21, 2003 (JP) ..... 2003-115664

(51) Int. Cl.
*F02N 17/00* (2006.01)

(52) U.S. Cl. ..... 123/179.17; 123/497

(58) Field of Classification Search ..... 123/497, 123/179.17, 456, 357, 495
See application file for complete search history.

(56) References Cited

U.S. PATENT DOCUMENTS 3,577,965 A * 5/1971 Sundberg ..... 60/726
4,117,821 A * 10/1978 Kawai ..... 123/179.16
4,284,053 A * 8/1981 Merrick ..... 123/497
4,586,468 A * 5/1986 Dzioba ..... 123/198 C
4,827,897 A * 5/1989 Yamada et al. ..... 123/497
5,255,643 A * 10/1993 Mochizuki et al. .... 123/179.17
5,507,266 A * 4/1996 Wright et al. ..... 123/497
6,543,425 B1 * 4/2003 Mayer et al. ..... 123/495
6,694,951 B1 * 2/2004 Frank ..... 123/495
2001/0011537 A1 * 8/2001 Joos et al ..... 123/497

FOREIGN PATENT DOCUMENTS

| | | |
|---|---|---|
| DE | 3404605 | 8/1983 |
| DE | 19741296 | 3/1999 |
| DE | 19903272 | 8/2000 |
| DE | 19939051 | 2/2001 |
| DE | 10127516 | 12/2002 |
| JP | 07332188 | 12/1995 |
| JP | 10-009074 | 1/1998 |
| JP | 11-132124 | 5/1999 |

* cited by examiner

*Primary Examiner*—Carl S. Miller
(74) *Attorney, Agent, or Firm*—Crowell & Moring LLP

(57) ABSTRACT

To perform fuel injection under fuel pressure as high as needed in an operation range of from cranking to self-sustaining operation via full expansion.

A fuel supply fuel system for a direct fuel injection type internal combustion engine is provided with a high-pressure fuel pump to directly inject fuel, which has been pressurized by the high-pressure fuel pump, from injectors into combustion chambers of the engine. An electromotor is arranged to auxilially drive the high-pressure fuel pump At the time of a start-up of the engine, driving of the high-pressure fuel pump or an assist to drive torque for the high-pressure fuel pump is performed by the auxiliary power means.

7 Claims, 8 Drawing Sheets

FUEL SUPPLY SYSTEM AND METHOD OF DIRECT FUEL INJECTION ENGINE

CLAIM OF PRIORITY

The present application claims priority from Japanese application serial no. 2003-115664, filed on Apr. 21, 2003), the content of which is hereby incorporated by reference into this application.

BACKGROUND OF THE INVENTION

This invention relates to a fuel supply system and method for a direct fuel injection type internal combustion engine in which is directly injected into a combustion chamber of the engine. It particularly relates to a fuel supply system and method for the engine of the spark ignition system useful as an automobile gasoline engine or the like.

In this kind of the engines with the spark ignition system, fuel (gasoline fuel) is directly injected into a combustion chamber of each cylinder by each injector. In order to assure a predetermined fuel pressure required for the direct fuel injection engine, the fuel to be supplied into the combustion chamber is pressured with a high-pressure fuel pump. The high-pressure fuel pump is connected with the camshaft which serves to drive intake and exhaust valves, and driven by a rotation power of the camshaft. The fuel pressurized by the high-pressure fuel pump is fed to the injector (for example, JP-A-04-393152).

In case of using the camshaft as a power source for the high-pressure fuel pump, the high-pressure fuel pump cannot be driven at a required speed during cranking at the time of a start-up of the engine, because the revolution speed of a crankshaft during cranking is low, and the revolution speed of the camshaft is also low accordingly. As a consequence, the pressure of fuel to be supplied to the injector cannot be brought to a fuel pressure required at the time of a start-up of the engine.

Accordingly, fuel cannot be injected into the combustion chamber under any sufficient fuel pressure during cranking of the engine. This results in insufficient atomization of fuel mist, and hence, coarse droplets of fuel as a liquid film adhere on a wall surface of each combustion chamber, so that a large amount of the fuel adhered as the liquid film is emitted as unburned fuel (HC) from the combustion chamber. During a self-sustaining operation after full expansion, the fuel adhered as the liquid film tends to be emitted as HC when the internal combustion engine is under cold engine conditions (under cold conditions). These cause deterioration in the emission performance of the internal combustion engine.

Examples of fuel supply systems for spark ignition engines of the direct fuel injection type, which have been developed to overcome this problem, is equipped with a high-pressure fuel pump connected with the camshaft of an internal combustion engine via a speed-increasing and variable speed device (for example, JP-A-10-009074).

In this fuel supply system, an actuator of the variable speed device is operated on the basis of a detection signal from a starter switch of the internal combustion engine, a fuel pressure sensor, a crank angle sensor or the like such that the variable speed device is changed over to a speed-increasing side to rotate the high-pressure fuel pump at a higher speed and thus, to pressurize the pressure of fuel. When the fuel pressure rises to a predetermined value or greater, and the start-up of the internal combustion engine is recognized to have completed by a start-up completion recognition means, the actuator is then operated to change over the variable speed device to a constant speed side such that the number of revolutions of the high-pressure fuel pump becomes consistent with that of the camshaft.

There are also some fuel supply systems in which by using force produced by an action of an driver prior to a start-up of an engine, an auxiliary start-up pump which is different from a high-pressure fuel pump is mechanically operated to pressurize beforehand fuel to be injected (for example, JP-A-11-132124).

With a fuel supply system such as that disclosed in JP-A-10-009074, the time required until the pressure of fuel reaches a predetermined value can be shortened compared with the conventional driving system without any variable speed device. Where the fuel pressure required during cranking is very high, for example, as high as 10 MPa or higher to increase the number of revolutions of the high-pressure fuel pump in interlocking with a starter switch of the internal combustion engine, however, the pressure of fuel from a turn-on of the starter switch until a first injection of fuel can hardly be raised to a target value in a short time. Moreover, the configuration of the high-pressure fuel pump including the variable speed device is accompanied by a problem that it is complex and requires high cost.

In a fuel supply system such as that disclosed in JP-A-11132124, it is considered possible to have the fuel pressure sufficiently reached a required value at the time of cranking. Due to a limitation on power to be generated based on an action of driver prior to a start-up of the engine, a limitation is imposed on the time during which the fuel pressure can be maintained at the required value. It is thus difficult to prevent fuel from adhering as a liquid film, which is a cause of HC emission, on the wall surface of each combustion chamber in the self-sustaining operation range after full expansion.

SUMMARY OF THE INVENTION

The present invention is, therefore, to provide a fuel supply system and control method for a direct fuel injection type internal combustion engine, which can realize fuel injection with a fuel pressure as high as needed in an operation range of from cranking of the engine until self-sustaining operation via full expansion, and can prevent from a deterioration in the emission performance due to increasing of HC emission.

To attain the above-described object, a fuel supply system according to the present invention for a direct fuel injection internal combustion engine comprising:

- a high-pressure fuel pump;
- injectors for injecting directly fuel pressurized by the high-pressure fuel pump into respective combustion chambers of the engine, and
- an auxiliary power unit connected with the high-pressure fuel pump,
- wherein at a time of starting of the engine, driving of the high-pressure fuel pump or an assist to drive torque for the high-pressure fuel pump is performed by the auxiliary power unit.

According to the fuel supply system of the present invention, the high-pressure fuel pump is driven by the auxiliary power means, or the drive torque for the high-pressure fuel pump is assisted by the auxiliary power unit upon starting of the internal combustion engine. This makes is possible to keep the predetermined fuel pressure (high pressure) during an operation range of from the time of cranking of the engine to a self-sustaining operation via fuel expansion. HC to be emitted from the internal combustion engine at the time of starting is considerably reduced by the effect for preventing fuel from adhering as a liquid film on the wall surface of each combustion chamber owing to the improvement of fuel vaporization of fuel mist.

In the fuel supply system according to the present invention, the auxiliary power unit may preferably comprise an electromotor. When the auxiliary power unit is the electromotor, it can comprise a motor generator which can be used also as generator when being made to drive by the cam shaft of the engine.

In the fuel supply system according to the present invention, the camshaft and the high-pressure fuel pump may preferably be connected by a one-way clutch, so even during stop of the engine without revolutions of the camshaft, the high-pressure fuel pump can still be driven by the auxiliary power unit.

The fuel supply system according to the present invention can have such configuration that a drive shaft of the high-pressure fuel pump and an output shaft of the auxiliary power unit may be operatively connected with each other by a power transmission mechanism to drive the high-pressure fuel pump, or that a clutch unit may be arranged between the auxiliary power unit and the high-pressure fuel pump to make the auxiliary power unit and the high-pressure fuel pump connect or disconnect. Owing to this configuration, the durability of the auxiliary power unit can be ensured by disconnecting the auxiliary power unit from the high-pressure fuel pump when the high-pressure fuel pump is not driven by the auxiliary power unit.

The fuel supply system according to the present invention further comprises a recognition means for recognizing completion of starting of the engine.

Wherein, at a time of starting of the engine, the auxiliary power unit and the high-pressure fuel pump are connected with each other by the clutch, and the high-pressure fuel pump is driven by the auxiliary power unit until the completion of starting of the engine is recognized by the recognition means. When completion of said starting is recognized, the auxiliary power unit and the high-pressure fuel pump are disconnected by the clutch to stop the operation of the auxiliary power unit. Owing to this configuration, by the completion of a start-up of the engine, the driving of the high-pressure fuel pump by the auxiliary power unit is stopped so that the above mentioned problems can be efficiently solved without wasteful consumption of electric power (energy).

When the internal combustion engine is temporarily stopped, the entire apparatus including the engine and a catalyst in an engine exhaust system is kept under activated conditions. When the engine is restarted, the temperature of the wall surface of each combustion chamber is hence still high. Accordingly, less fuel adheres as a liquid film to inner surface of the cylinder to the engine, so that HC to be emitted from the engine is reduced, and in addition, emitted HC is substantially purified by the catalyst arranged in an exhaust pipe and is then emitted from the vehicle. It is, therefore, desired to recognize the completion of a start-up of the engine by the temperature of the catalyst, that is, the activated conditions of the catalyst or the coolant water temperature or engine oil temperature of the internal combustion engine.

Accordingly, the start-up recognition means preferably performs recognition of a start-up of the engine based on an engine coolant water temperature, an engine oil temperature or the temperature of a catalyst in an exhaust system of the engine. And when the engine is started up at a temperature higher than a temperature based on which the completion of a start-up is recognized by the start-up recognition means, the high-pressure fuel pump may be driven by the camshaft from immediately after the start-up of the internal combustion engine without using the auxiliary power unit. As a consequence, the above mentioned problems can be efficiently solved without wasteful consumption of electric power.

The fuel supply system according to the present invention may further comprise a warming up condition detection means for detecting warming up conditions of the internal combustion engine. Driving of the high-pressure fuel pump or assisting to drive torque for the high-pressure fuel pump is performed by the auxiliary power unit only at a cold start that the engine has not reached predetermined warming up conditions. As a consequence, the above mentioned problems can be efficiently solved without wasteful consumption of electric power.

In the fuel supply system according to the present invention, the auxiliary power unit may be driven by turn-on of a starter switch of the engine or turn-on of an ignition switch of the engine. Therefore, the start-up timing of the auxiliary power unit can be set either at the time of turn-on of the starter switch or at the time of turn-on of the ignition switch. In particular, when the auxiliary power unit is driven by the turn-on of the ignition switch, the pressure of fuel can be sufficiently raised in the course of subsequent cranking of the internal combustion engine by the turn-on of the starter switch.

The fuel supply system according to the present invention may further comprise a sensor for detecting an action to be performed by an driver until the internal combustion engine is started up. On the basis of a detection signal from the sensor, the high-pressure fuel pump is driven by the auxiliary power unit prior to a start-up of the internal combustion engine.

In the fuel supply system according to the present invention, it is possible to surely have the pressure of fuel reached a predetermined value in the course of cranking without taking limitation on the time from cranking to full expansion of the engine. Further, a demand from users, although there is a limitation on the time needed from cranking to full expansion of the engine, this configuration can satisfy both of the need for raising the pressure of fuel to the predetermined value upon start-up of the engine and the need for the limited time from cranking to full expansion.

When the internal combustion engine is for use on a vehicle such as an automobile, the sensor for detecting the action by the driver may simply comprise any one of a door lock release sensor for detecting a release of a door lock of the vehicle, a door open/close sensor for detecting opening or closing of a door of the vehicle and a seating sensor for detecting seating of the driver on an driver's seat of the vehicle.

When a starter switch of the engine is not turned on even after a predetermined time has elapsed from input of a detection signal from the sensor for detecting the action by the driver, the driving of the high-pressure fuel pump by the auxiliary power unit may be stopped. This configuration allows the high-pressure fuel pump to automatically stop if the driver does not actually start up the engine despite the high-pressure fuel pump is started up prior to a start-up of the internal combustion engine.

When the starter switch is turned on after a predetermined time has elapsed from the input of the detection signal from the sensor for detecting the action by the driver, the high-pressure fuel pump may be driven by the camshaft, and the high-pressure fuel pump may also be driven by the auxiliary power unit. By driving the high-pressure fuel pump with the engine and auxiliary power unit as described above, the pressure of fuel can be raised in a short time, thereby enabling pressure of fuel to more surely reach a target value until cranking.

The driving of the high-pressure fuel pump by the auxiliary power unit after the starter switch is turned on may be performed only at a cold time that warm-up conditions of the engine have not reached predetermined warm-up conditions. And at a time point that the engine has reached the predetermined warm-up conditions, the driving of the high-pressure fuel pump by the auxiliary power unit may be stopped. This configuration can efficiently solve the problem without wasteful consumption of electric power.

Similar to conventional fuel supply systems, the fuel supply system according to the present invention may be provided with a low-pressure fuel pump for pumping up fuel from a fuel tank, and the high-pressure fuel pump is fed with the fuel pumped up from the fuel tank by the low-pressure fuel pump.

To achieve the above-mentioned object, another fuel supply system according to the present invention further comprises a low-pressure fuel pump for pumping up fuel from a fuel tank, and a high-pressure fuel pump for being fed with fuel from the low-pressure fuel pump, pressuring the fuel from the low-pressure fuel pump and supplying the pressurized fuel to an injector such that the fuel pressurized by the high-pressure fuel pump is injected directly into a combustion chamber of the engine from the injector. Wherein the high-pressure fuel pump is an electric operated pump driven by an electromotor.

In the fuel supply system according to the present invention, the driving of the high-pressure fuel pump is performed by the electrically-operated pump over the entire operation range of the engine. The pressure control of fuel can be optimally performed with a high degree of freedom only by controlling the operation of the electric pump.

To achieve the above-mentioned object, a fuel supply method according to the present invention comprising:

- pressurizing fuel from a fuel tank with a high-pressure fuel pump;
- injecting directly fuel pressurized by the high-pressure fuel pump into each combustion chamber of the engine with each injector in turn;
- connecting the high-pressure fuel pump with an auxiliary power unit in addition to a camshaft, and at a time of starting of the engine, driving the high-pressure fuel pump or assisting drive torque for the high-pressure fuel pump by the auxiliary power unit.

According to the fuel supply method according to the present invention, fuel can be kept at a predetermined pressure (high pressure) over the entire operation range of from the time of cranking to full expansion of the engine by driving the high-pressure fuel pump, or by assisting to drive torque for the high-pressure fuel pump with the auxiliary power unit upon start-up of the engine. Owing to an effect of preventing adhesion of fuel as a liquid film on the wall surface of each combustion chamber by improvement of vaporization of fuel mist, it is, therefore, possible to considerably reduce HC emission from the internal combustion engine upon start-up of the internal combustion engine.

DETAILED DESCRIPTION OF THE INVENTION

Embodiments of the present invention will hereinafter be described with reference to the accompanying drawings.

Figure 1:
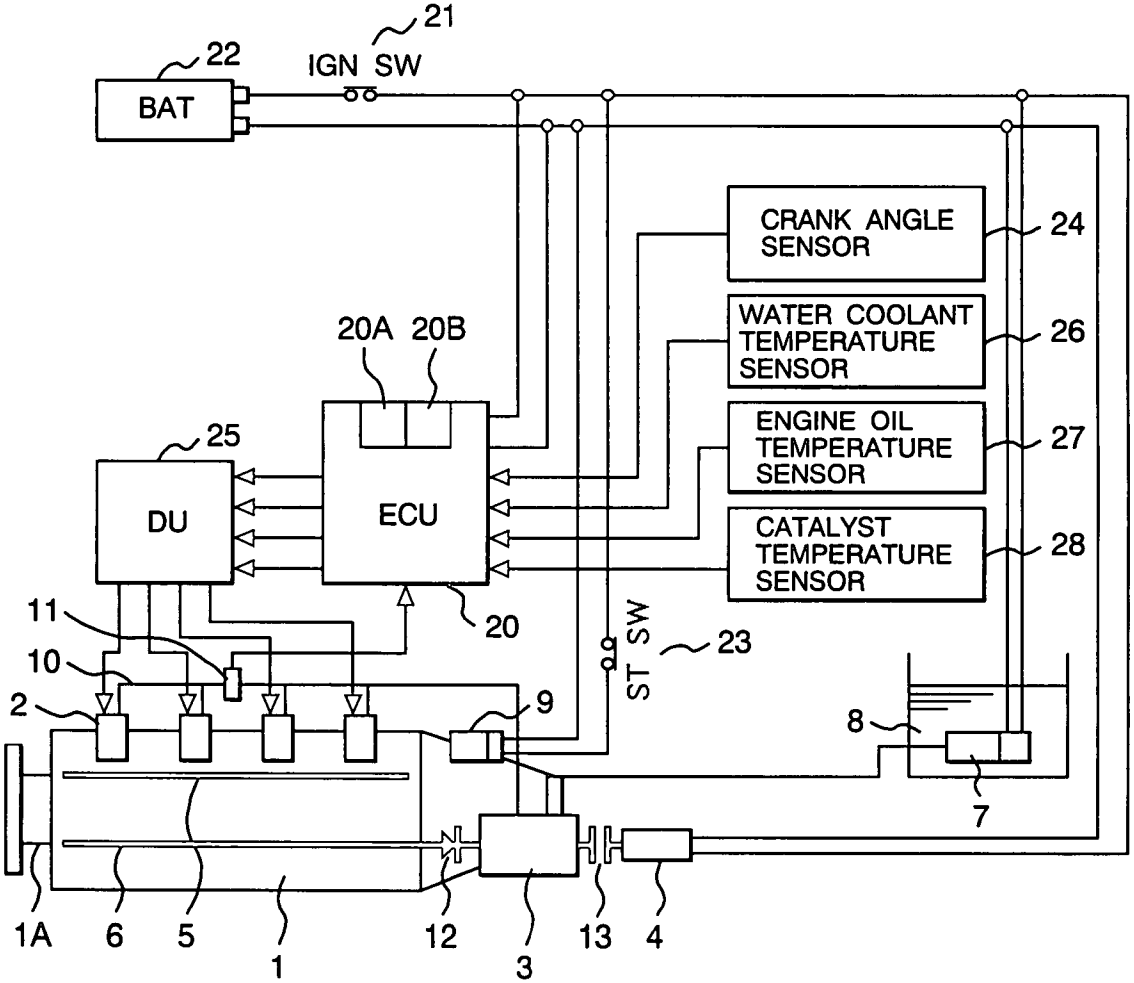
FIG. 1 is an overall configuration diagram of a fuel supply system according to a first embodiment of the present invention for a direct fuel injection type internal combustion engine.

FIG. 1 shows the outline of the overall configuration of a fuel supply system according to a first embodiment of the present invention for a direct fuel injection type internal combustion engine.

An internal combustion engine 1 is provided at each cylinder with an injector 2 for directly injecting fuel (gasoline fuel) into a corresponding unillustrated combustion chamber. In this embodiment, the internal combustion engine is a four-cylinder internal combustion engine, and has four injectors 2 arranged.

The internal combustion engine 1 is a spark ignition engine of the double overhead camshaft (DOHC) type, and is provided with an intake camshaft 5 and an exhaust camshaft 6 driven rotatably by a crankshaft 1A to open and close unillustrated intake valves and exhaust valves. The internal combustion engine 1 has a starter 9 to make the engine start up, namely, cranking.

The internal combustion engine 1 is also provided with a low-pressure fuel pump 7 and high-pressure fuel pump 3 as fuel supply devices for supplying fuel to the injectors 2.

The low-pressure fuel pump 7 is similar to an electric fuel pump used in a fuel supply system for a fuel injection type internal combustion engine, and pumps up fuel from a fuel tank 8. The high-pressure fuel pump 3 raises the pressure of fuel pumped up from the fuel tank 8 by the low-pressure fuel pump 7 and supplies high-pressure fuel to the injectors 2 via a high-pressure fuel piping 10 such as a fuel delivery pipe.

A fuel pressure sensor 11 is arranged on the high-pressure fuel piping 10 to monitor the fuel pressure of high-pressure fuel to be supplied into the injectors 2.

An electronic control unit (ECU) 20 for controlling the internal combustion engine is a microcomputer, and is supplied with electric power from a battery 22 upon turning on an ignition switch 21 for the internal combustion engine 1. The ignition switch 21 is turned on or turned off by driver's key operation.

Upon starting up the engine, a starter switch 23 for the internal combustion engine 1 is turned on by driver's key operation to drive the starter 9. This driving of the starter 9 makes the crankshaft 1A of the internal combustion engine 1 rotate, so fuel injection pulse signals are outputted from ECU 20 on the basis of respective detection signals from a crank angle sensor 24 installed in the internal combustion engine 1. The signals outputted are boosted by a driver unit (DU) 25 to a voltage level required for the operation of the injectors 2 and are then inputted to the respective injectors 2.

The high-pressure fuel pump 3 is connected with an end portion of the exhaust camshaft 6 via a one-way clutch 12. An electromotor 4 used for an auxiliary power unit is connected with the high-pressure fuel pump 3 via an electromagnetic clutch 13 to drive the high-pressure fuel pump. The electromagnetic clutch 13 is provided between the electromotor 4 and the high-pressure fuel pump 3, and is engaged or disengaged to make the electromotor 4 and the high-pressure fuel pump 3 connect or disconnect.

In this embodiment, the high-pressure fuel pump 3 is arranged on the side of the exhaust camshaft 6. The high-pressure fuel pump 3 may be arranged on the side of the intake camshaft 5 without any problem insofar as arrangement of a variable mechanism or the like on the intake camshaft 5 is not interfered.

Figure 2A:
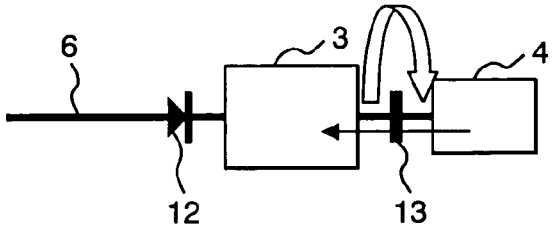
FIGS. 2(*a*) and 2(*b*) are schematic diagrams of operations of a high-pressure pump for the fuel supply system of FIG. 1 upon start-up of the engine.
Figure 2B:
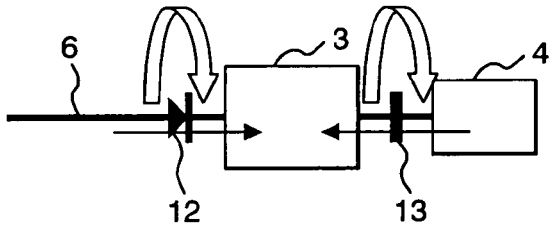

With reference to FIGS. 2(*a*) and 2(*b*), a description will next be made about the examples (1) and (2) of an operation of the high-pressure fuel pump 3 in the first embodiment of the present invention upon starting of the engine.

EXAMPLE (1)

Of the Operation Upon Starting of the Engine

Firstly, the ignition switch 21 of the internal combustion engine 1 is turned on. Prior to cranking the internal combustion engine 1, the low-pressure fuel pump 7 is driven, and, as illustrated in FIG. 2(*a*), the electromagnetic clutch 13 is engaged to connect the electromotor 4 and the high-pressure fuel pump 3 with each other such that the high-pressure fuel pump 3 is driven by the motor 4.

Since the one-way clutch 12 is arranged between the exhaust camshaft 6 and the high-pressure fuel pump 3, the high-pressure fuel pump 3 is still driven by power from the electromotor 4 even when the internal combustion engine 1 is in a pre-cranking, non-operated state and the exhaust camshaft 6 is in an unrotatable state. The driving of the high-pressure fuel pump 3 makes it possible to supply high-pressure fuel to the high-pressure fuel piping 10 and the injectors 2.

EXAMPLE (2)

Of the Operation Upon Starting of the Engine

When turning on the starter switch 23 of the internal combustion engine 1, the starter 9 is driven, and the electromagnetic clutch 13 is engaged to drive the electromotor 4. In this case, as illustrated in FIG. 2(*b*), the driving torque for the high-pressure fuel pump 3 is assisted by power from the electromotor 4 in addition to the drive of the high-pressure fuel pump 3 by rotational power from the exhaust camshaft 4.

As a result, compared with driving only by a camshaft as in the conventional art, greater power can be generated at the high-pressure fuel pump 3 so that fuel pressure can be raised in a short time.

ECU 20 is provided with a built-in timer 20A for clocking time to recognize that a predetermined time has elapsed after start-up of cranking, or provided with a start-up completion recognition function 20B. The start-up completion recognition unit 20B recognizes the completion of a start-up (starting) of the internal combustion engine 1, for example, on the basis of an engine coolant water temperature, an engine oil temperature and a catalyst temperature detected by a water temperature sensor 26, an engine oil temperature sensor 27 and an exhaust system catalyst temperature 28, respectively. These temperature sensors also function as warming up condition detection means for detecting warming up conditions of the internal combustion engine 1.

Figure 3:
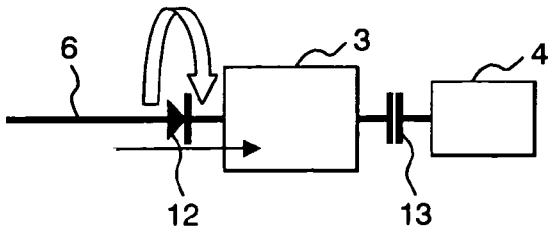
FIG. 3 is a schematic diagram of an operation of the high-pressure pump of FIG. 2 after a change-over of its drive source.

In both of the examples (1) and (2) of the operation upon start-up, when being recognized that the predetermined time has elapsed after cranking as a result of the measurement of time by the built-in timer 20A, or being recognized that a start-up has completed by the start-up completion recognition function 20B, as shown in FIG. 3, ECU 20 stops operation of the electromotor 4, and then make the electromagnetic clutch 13 disengage to disconnect the electromotor 4 and the high-pressure fuel pump 3 from each other. Further ECU 20 switches the drive means for the high-pressure fuel pump 3 from the electromotor 4 to the exhaust camshaft 6.

The above-described switching permits a reduction in the size of the electromotor 4 while assuring its durability.

When the internal combustion engine 1 is started up at a temperature higher than a temperature on which the completion of a start-up is recognized by the start-up completion recognition function 20B, the high-pressure fuel pump 3 is driven by the exhaust camshaft 6 from immediately after the start-up of the internal combustion engine 1 without using the electromotor 4 as an auxiliary power source. This allows to avoid wasteful consumption of electric power.

Figure 4:
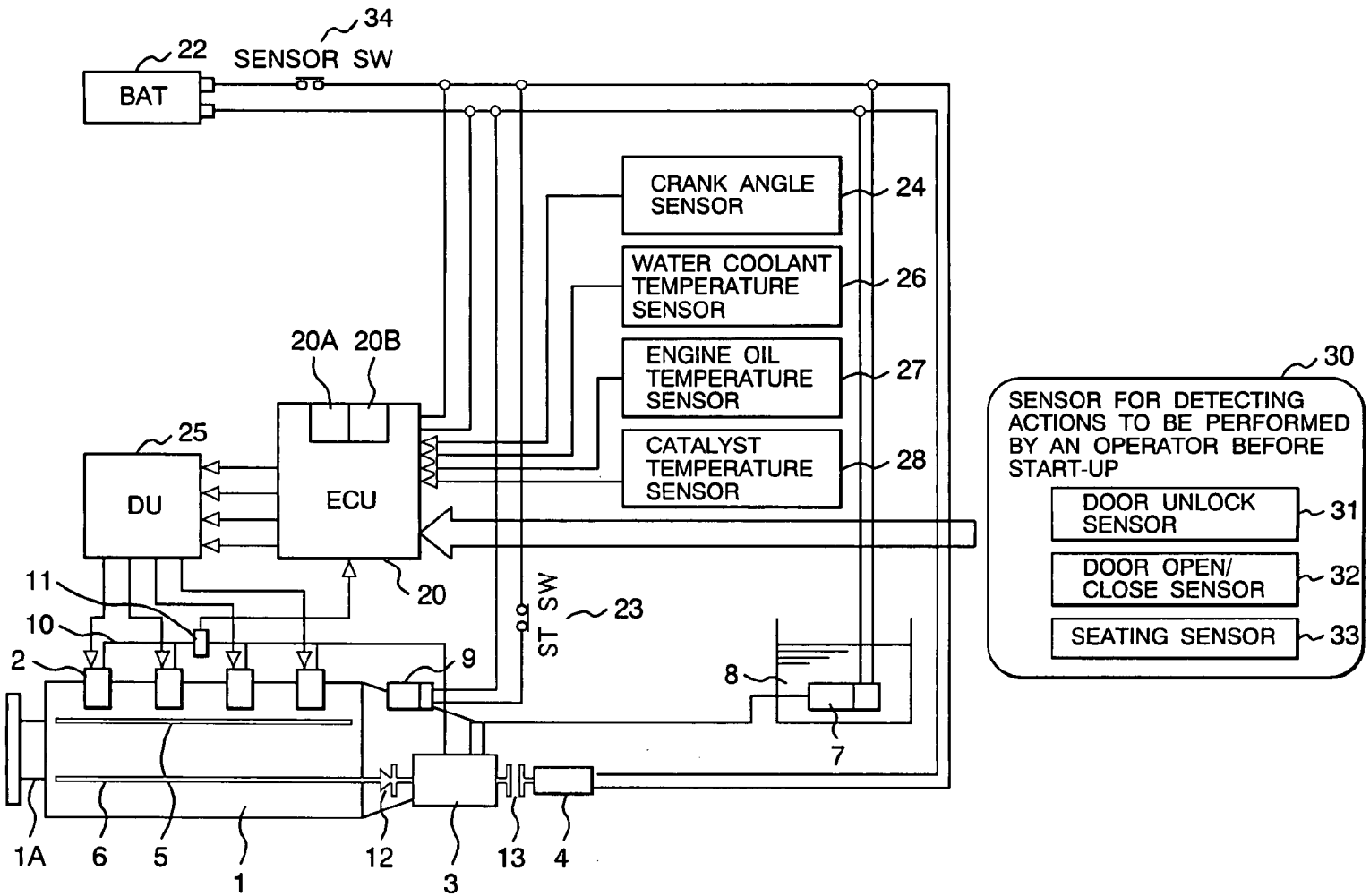
FIG. 4 is an overall configuration diagram of a fuel supply system according to a second embodiment of the present invention for a direct fuel injection type internal combustion engine.

FIG. 4 shows the outline of an overall configuration of a fuel supply system according to a second embodiment of the present invention for a direct fuel injection type internal combustion engine. In FIG. 4, those elements and units of the system which are the same as or equivalent to corresponding ones in FIG. 1 are indicated by the same reference signs or numerals, and their description will be omitted.

In the second embodiment, the low-pressure fuel pump 7 and the electromotor 4 are driven based on the detection signals from a sensor 30 which detects driver's actions to be performed until the driver make the internal combustion engine 1 of a vehicle such as an automobile stat up.

The expression "actions to be performed until the driver starts up the engine" as used herein means, for example, a door lock release of the automobile, door opening/closure, seating and the like, and can include any other action or actions which the driver may always perform before a start-up, and no particular limitation is imposed thereon. By detection signals from sensors for detecting these actions (a door lock release sensor 31, a door open/close sensor 32, a seating sensor 33 and the like), a sensor switch 34 is turned on to drive the low-pressure fuel pump 7 and the electromotor 4, namely, the high-pressure fuel pump 3.

This has eliminated the limitation on the time required to reach a target fuel pressure which has remained as a problem in the conventional ignition-switch-interlocked system, and at the time of starting of the internal combustion engine 1, the pressure of fuel is assured to reach a target value.

Accordingly, it possible to inject fuel under high pressure from the injectors 2. Further owing to an effect of improvement of fuel vaporization by particlizatin of the fuel spray, it is possible to reduce the amount of fuel that adheres on the wall of each combustion chamber in the form of a liquid film as a primary cause of the troublesome HC emission at a cold start.

In practice, the amount of HC to be emitted from the internal combustion engine 1 is considerably affected by activated conditions of a catalyst arranged in an exhaust pipe and by the temperature of the wall of each combustion camber of the engine. Described specifically, in case of restarting the engine under the catalyst being kept an activation or the wall surface of each combustion chamber being at a temperature equal to or higher than a predetermined temperature, for example, when the internal combustion engine 1 is restarted in a short time after once stopped, it is considered that no HC emission problem arise even when the high-pressure fuel pump 3 is driven by the camshaft from the time of a start-up as in the conventional art.

When the durability and deterioration of the electromotor 4 are taken into consideration, it is desired to select a start-up method depending on the conditions of warming-up of the engine as described above. The state of activation of the catalyst and the temperature of the wall surface of each combustion chamber of the engine can be estimated, for example, by directly detecting the temperature of the catalyst with a thermocouple or the like or by detecting an engine coolant water temperature or an engine oil temperature.

Using a flow chart of FIG. 5, a description will next be made of a specific control sequence by taking as an example the case of a door lock release as driver's action before an engine start-up.

Firstly, a release of a door lock of an automobile by a driver is detected by the door lock release sensor 31, and the sensor switch 34 is turned on (Step S1). The low-pressure fuel pump 7 is driven by the turn-on of the sensor switch 34 (Step S2).

It is then recognized whether or not the water temperature (engine coolant water temperature) at this time (at the time of the door lock release) is higher than a predetermined value (Step S3). If the water temperature detected by the water temperature sensor 27 is higher than the predetermined value (Step S3, "Yes"), the catalyst temperature and the wall surface temperature of the each combustion chamber of the engine are recognized that they has kept the predetermined temperatures. And the starter switch 23 is monitored for its turn-on as long as the water temperature keeps equal to or higher than the predetermined value (Step S4). When the starter switch 23 is turned on, the high-pressure fuel pump 3 is driven by the exhaust camshaft 6 from the time of start-up without relying upon the electromagnetic motor 4 (Step S5).

If the water temperature is recognized not to be equal to or not to be higher than the predetermined value (Step S3, "No"), the electromagnetic clutch 13 arranged between the high-pressure fuel pump 3 and the electromotor 4 is engaged (Step S6), and at the same time, the electromotor 4 is started (Step S7). As a result, the high-pressure fuel pump 3 is driven by the electromotor 4. Counting of an elapsed time is then started from immediately after the start-up of the electromotor 4 (Step S8).

After this, if the starter switch 23 is off, the time elapsed from the start-up of the electromotor 4 for driving the high-pressure fuel pump is counted on (Step S8). If the starter switch is turned on within a predetermined time elapsed from the start-up of the electromotor for driving the high-pressure fuel pump (Step S9, "No"), fuel injection is started simultaneously with a start-up of the internal combustion engine 1 (Step S11), cranking is effected to achieve full expansion.

If the starter switch 23 is not turned on until the predetermined time elapses from the start-up of the electromotor 4 for driving the high-pressure fuel pump, on the other hand, the electromotor 4 is stopped and the electromagnetic clutch 13 is disengaged (Step S12). If the door is not locked after this (Step S13, "No"), the starter switch 23 is monitored (Step S14).

When the starter switch 23 is turned on (Step S14, "Yes"), the electric magnetic clutch 13 is immediately engaged (Step S15) and in addition to drive of the high-pressure fuel pump 3 by the exhaust camshaft 6, the electromotor 4 is started to assist the drive torque for the high-pressure fuel pump 3 (Step S16).

While the starter switch 23 remains off (Step S14, "No"), Step 13 to Step 14 are repeated until the door is locked. If the door is locked without turning on of the starter switch 23 (Step S13, "Yes"), the drive of the low-pressure fuel pump 7 is stopped at the same time (Step S17) and the routine is ended. Incidentally, no problem arises with the recognition in Step 13 even if the door lock is an action by one other than the driver.

A description will next be made about change-over control of the power source for the high-pressure fuel pump 3 from the electromotor 4 to the exhaust camshaft 6 when the internal combustion engine 1 is started up with the high-pressure fuel pump 3 being driven by the electromotor 4.

Figure 5:
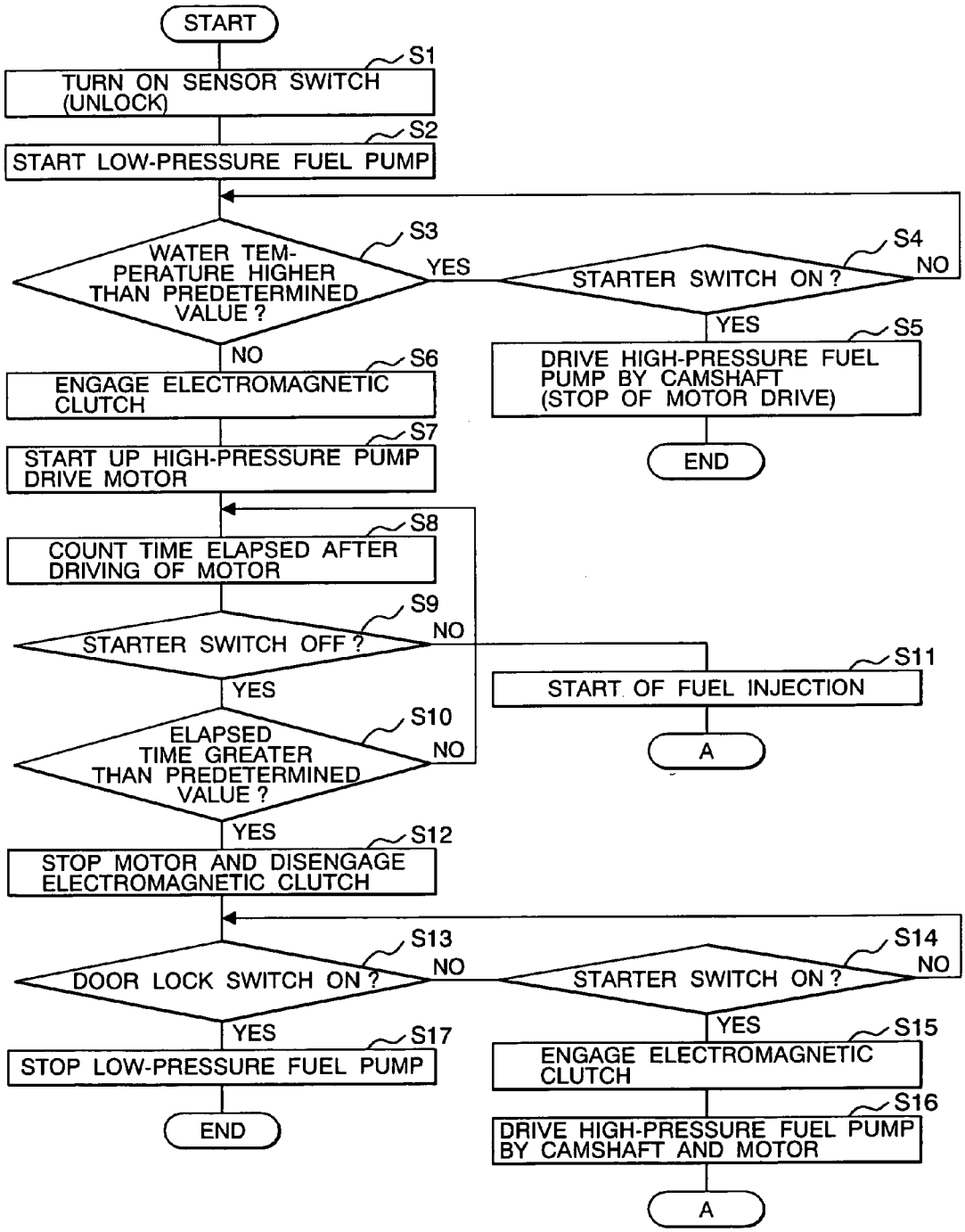
FIG. 5 is a flow chart illustrating sequence up to a start-up of the internal combustion engine in the fuel supply system of FIG. 4 for the engine.

When the engine is started up in a step A of FIG. 5 (a post-step of Step 11), the operation of the electromotor 4, which is driving the high-pressure fuel pump 3 or assisting the drive torque for it depending on the temperature of the engine coolant water, is stopped (cut-off of electric power), and the drive of the high-pressure fuel pump 3 is changed to driving by the exhaust camshaft 6 alone.

Figure 6:
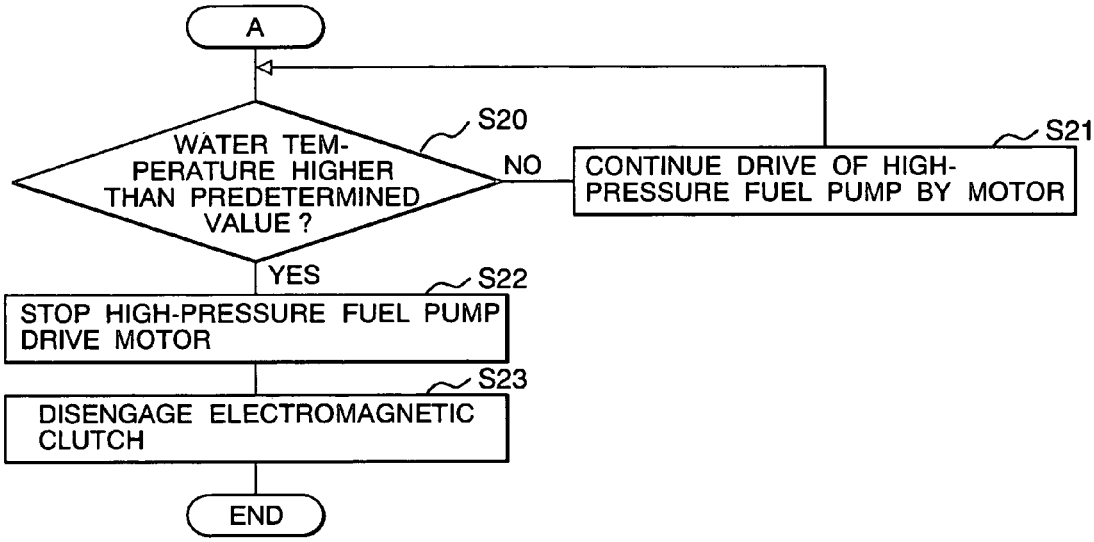
FIG. 6 is a flow chart illustrating sequence upon changing over the power source of high-pressure pump in FIG. 4.

FIG. 6 shows a flow chart of sequence upon change-over of the power source for the high-pressure fuel pump 3.

If the water temperature detected by the water temperature sensor 27 is not equal to or higher than the predetermined value (Step S20, "No"), the high-pressure fuel pump 3 continues to be driven by the electromotor 4 (Step S21). If the water temperature rises to the predetermined value or higher (Step S20, "Yes"), the operation of the electromotor 4 is stopped (Step S22) and drive of the high-pressure fuel pump 3 is changed to driving by the exhaust camshaft 6. Thereafter, the electromagnetic clutch 13 which is connecting the high-pressure fuel pump 3 and the electromotor 4 with each other is disengaged (Step S23), thereby completing the change-over of the power source for the high-pressure fuel pump 3.

Figure 7:
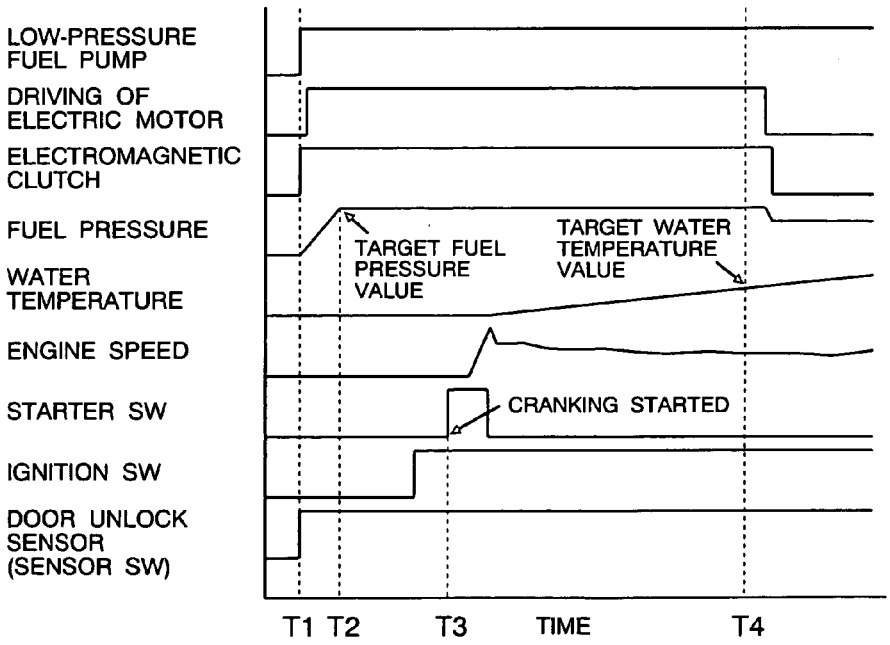
FIG. 7 is a time chart showing the history of opening/closing of individual switches, engine conditions and actuator operations in the high-pressure fuel pump of FIG. 4 for the direct fuel injection type internal combustion engine after a start-up of the engine.

FIG. 7 is a time chart which shows the history on turn-on/turn-off of the individual switches, engine conditions and actuator operations after a start-up of the engine when the water temperature at the start-up of the engine is lower than the predetermined value.

When a door lock release is detected by the door lock release sensor 31 at time point T1, the sensor switch 34 is turned on. In synchronization with the turn-on of the sensor switch 34, the low-pressure fuel pump 7 is driven, and the electromagnetic clutch 13 is engaged. The electromotor 4 is then started up.

It is considered that at least 5 seconds or so are generally required until the starter switch 23 in a parked automobile is turned on (time point T3) subsequent to releasing of the door lock of the automobile. Taking into this fact, it is sufficiently possible to have the pressure of fuel—which is to be supplied to the injectors 2, for example, at time point T2—reached a target fuel pressure until the starter switch 23 is turned on after the driving of the high-pressure fuel pump 3 by the electromagnetic motor 4 at the same time as the door lock release.

The internal combustion engine 1 is started up, in other words, performs cranking upon driving of the starter 9 by turn-on of the starter switch 23 at time point T3. The internal combustion engine 1 then performs full expansion and furthermore, comes into idling conditions.

The coolant water temperature of the internal combustion engine 1 rises with time as a result of combustion in the engine. Reaching a predetermined temperature at time point T4, the operation of the electromotor 4 is stopped, and the electromagnetic clutch 13 connecting the high-pressure fuel pump 3 and the electromotor 4 with each other is disengaged. After this operation, the high-pressure fuel pump 3 is, therefore, driven by rotation power of the exhaust camshaft 6.

Figure 8:
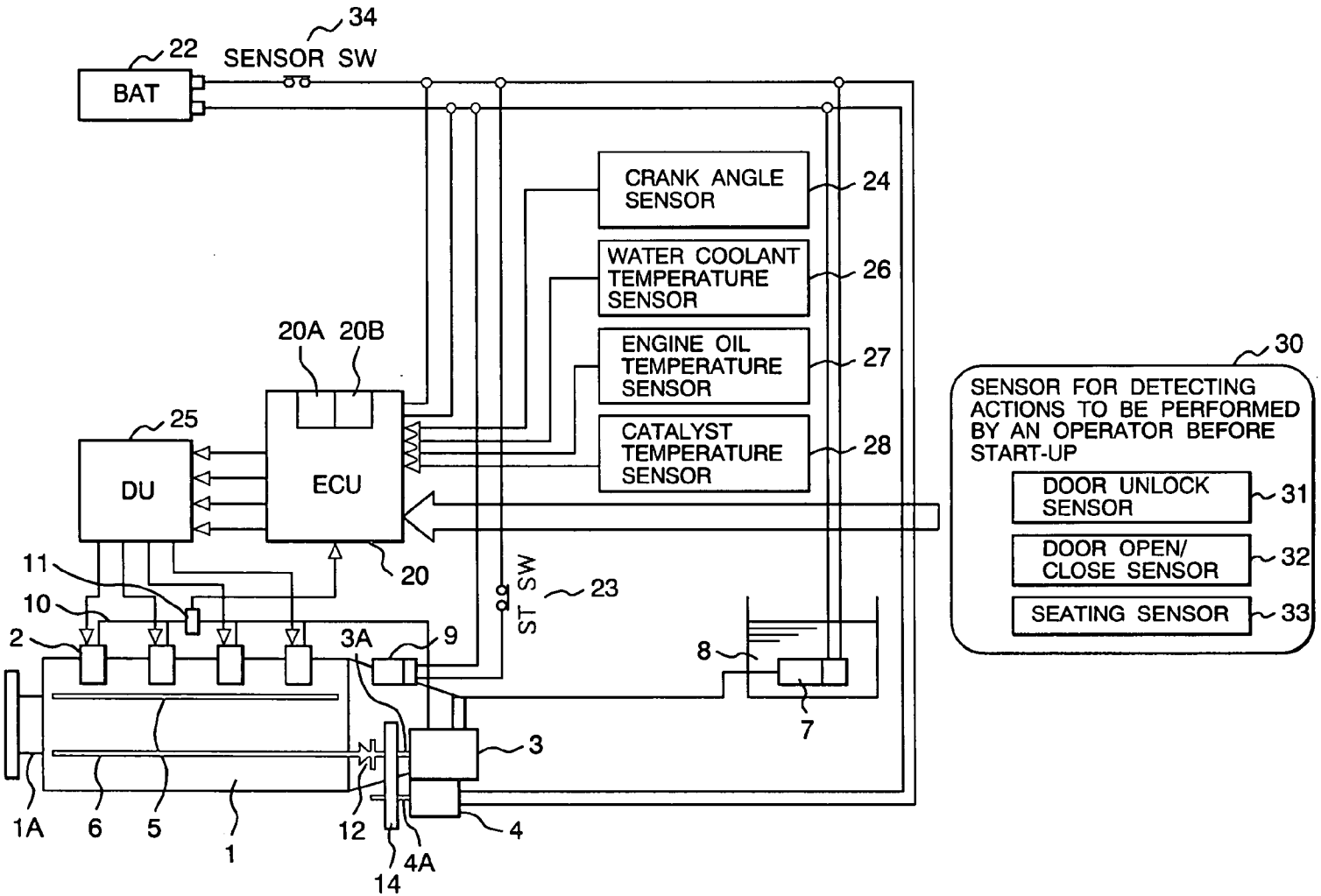
FIG. 8 is an overall configuration diagram of a fuel supply system according to a third embodiment of the present invention for a direct fuel injection type internal combustion engine.

FIG. 8 shows the outline of an overall configuration of a fuel supply system according to a third embodiment of the present invention for a direct fuel injection type internal combustion engine. In FIG. 8, those elements and units of the system which are the same as or equivalent to corresponding ones in FIG. 1, and FIG. 4 are indicated by the same reference signs or numerals, and their description will be omitted.

In this embodiment, a drive shaft 3A of the high-pressure fuel pump 3 and an output shaft 4A of the electromotor 4 are connected together by a drive belt 14. The high-pressure fuel pump 3 and the electromotor 4 are connected with the exhaust camshaft 6 via the one-way clutch 12 such that the high-pressure fuel pump 3 and the electromotor 4 are arranged in a mutually-parallel relationship.

In the first and second embodiments, the power of the internal combustion engine 1 is not transmitted to the side of the electromotor 4 by disengaging the electromagnetic clutch 13 upon stopping the electromotor 4.

Figure 9A:
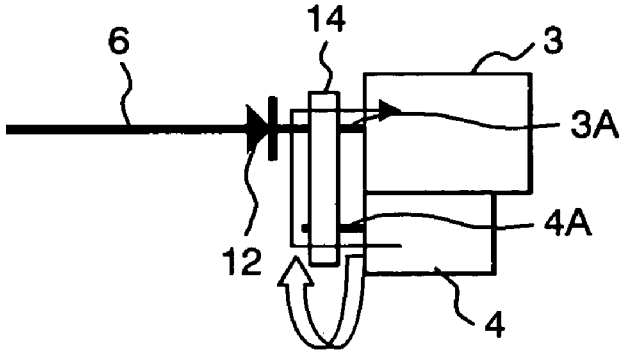
FIGS. 9(*a*) and 9(*b*) are schematic diagrams of operations of the high-pressure fuel pump in the fuel supply system of FIG. 8 according to the third embodiment upon start-up of the high-pressure fuel pump and after a charge-over of its drive source.
Figure 9B:
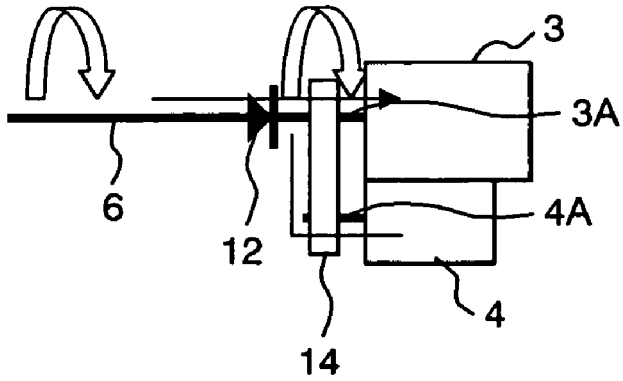

In the third embodiment in which the high-pressure fuel pump 3 and the electromotor 4 are connected together by the drive belt 14, the high-pressure fuel pump 3 is driven by the electromotor 4 at the time of a cold start as shown in FIG. 9(*a*). As in the first and second embodiments, the power source used for the high-pressure fuel pump 3 is changed to the exhaust camshaft 6, for example, when the water temperature reaches the predetermined value. In this state, the power from the internal combustion engine 1 is transmitted to the electromotor 4 via the one-way clutch 12 as shown in FIG. 9(*b*).

This makes it possible to operate the electromotor 4 as a motor generator. Except for the time of an engine start-up, energy can be regenerated to charge the battery 22 and to use this regenerative energy for driving accessories. In this embodiment, basic control at the time of an engine start-up is similar to the control in the second embodiment as shown in FIG. 5 to FIG. 7.

It is to be noted that the use of the electromotor 4 as auxiliary power unit in the first to third embodiments is merely illustrative. As an alternative, the high-pressure fuel pump can also be driven by an auxiliary power unit, for example, such as a pneumatic motor making use of compressed air or the like.

Figure 10:
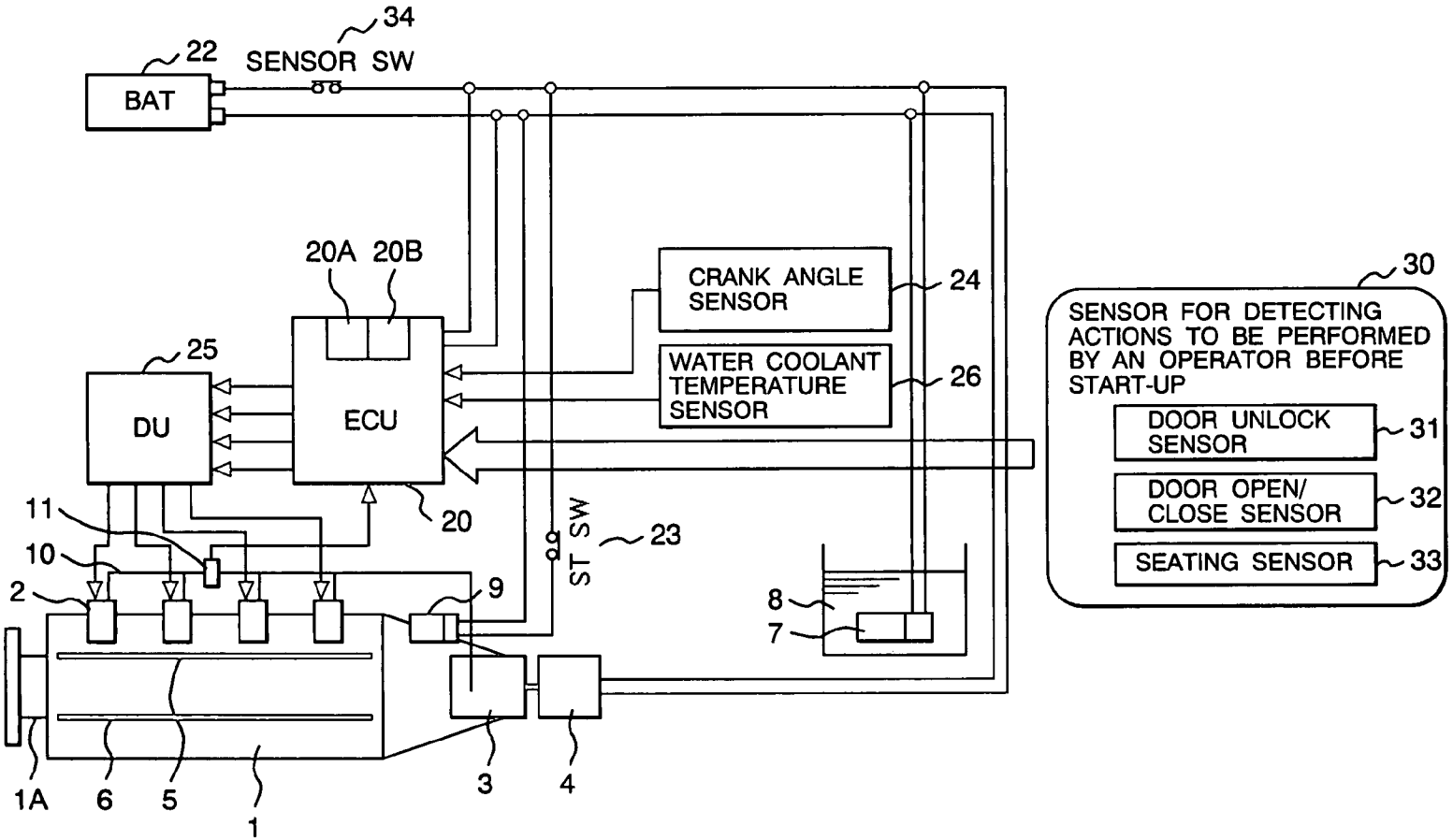
FIG. 10 is an overall configuration diagram of a fuel supply system according to a fourth embodiment of the present invention for an in-cylinder fuel injection internal combustion engine.

FIG. 10 shows the outline of an overall configuration of a fuel supply system according to a fourth embodiment of the present invention for an in-cylinder fuel injection internal combustion engine. In FIG. 10, those elements and units of the system which are the same as or equivalent to corresponding ones in FIG. 1 and FIG. 4 are indicated by the same reference signs or numerals, and their description will be omitted.

In the fourth embodiment, the high-pressure fuel pump 3 is completely independently driven by the electromagnetic motor 4 without relying upon the camshaft. In this embodiment, the high-pressure fuel pump 3 is hence driven by the electromotor 4 over the entire operation range.

The use of such configuration as described above makes it possible to start the high-pressure fuel pump 3 absolutely freely and to have the pressure of fuel reached a target value before start-up cranking of the internal combustion engine 1.

In this configuration, however, the electromotor 4 is continuously driven during operation of the internal combustion engine 1. As a result, a considerably larger electromagnetic motor is required as the electromotor 4. If this problem can be solved, this configuration is considered to be most desirable in view of its high freedom in the control of fuel pressure.

As appreciated from the above description, at the time of the start-up of the engine, the high-pressure fuel pump 3 is driven by an auxiliary power unit such as an electromotor, or the drive torque for the high-pressure fuel pump is assisted by such an auxiliary power unit. Thereby, the fuel supply system and method of the present invention for the direct fuel injection type internal combustion engine make it possible to maintain a predetermined fuel pressure during an operation range of from the time of cranking of the internal combustion engine to a self-sustaining operation via fuel expansion. And HC to be emitted from the internal combustion engine at the time of a start-up can be reduced effectively owing to the effect for preventing fuel from adhering as a liquid film on the wall surface of each combustion chamber by the improvement of fuel vaporization.

What is claimed is:

1. A fuel supply system for a direct fuel injection type internal combustion engine comprising:

a high-pressure fuel pump;

injectors for injecting directly fuel pressurized by said high-pressure fuel pump into respective combustion chambers of said engine, and an auxiliary power unit configured as an electromotor connected with said high-pressure fuel pump, wherein at a time of starting of said engine, driving of said high-pressure fuel pump or an assist to drive torque for said high-pressure fuel pump is performed by said auxiliary power unit, wherein said electromotor is a motor/generator which can be used also as a generator when driven by a cam shaft of said engine.

2. The fuel supply system according to claim 1, wherein said camshaft and said high-pressure fuel pump are connected with each other by a one-way clutch.

3. The fuel supply system according to claim 1, further comprising means for detecting warming up conditions of said engine, wherein driving of said high-pressure fuel pump or an assist to drive torque for said high-pressure fuel pump is performed by said auxiliary power unit only at a cold start when said engine has not reached predetermined warming up conditions.

4. A fuel supply system for a direct fuel injection type internal combustion engine comprising:

a high-pressure fuel pump;

injectors for injecting directly fuel pressurized by said high-pressure fuel pump into respective combustion chambers of said engine, an auxiliary power unit configured as an electrometer connected with said high-pressure fuel pump, wherein at a time of starting of said engine, driving of said high-pressure fuel pump or an assist to drive torque for said high-pressure fuel pump is performed by said auxiliary power unit, wherein a clutch is provided between said high-pressure fuel pump and said auxiliary power unit to connect and disconnect them, and means for recognizing completion of starting of said engine, wherein, at a time of starting of said engine, said auxiliary power unit and said high-pressure fuel pump are connected with each other by said clutch to drive said high-pressure fuel pump by said auxiliary power unit until said completion of starting of said engine is recognized by said recognition means, and when completion of said starting is recognized, said auxiliary power unit and said high-pressure fuel pump are disconnected by said clutch to stop the operation of said auxiliary power unit, wherein sais recognition means recognizes starting of said engine based on an engine coolant water temperature, and engine oil temperature or a temperature of a catalyst in an exhaust system of said engine, and when said engine is started up at a temperature higher than the temperature for recognizing starting of said engine, said high-pressure fuel pump is driven by a camshaft from immediately after starting of said engine without using said auxiliary power unit.

5. A fuel supply system for a direct fuel injection type internal combustion engine comprising:

a high-pressure fuel pump, injectors for injecting directly fuel pressurized by said high-pressure fuel pump into respective combustion chambers of said engine, an auxiliary power unit connected with said high-pressure fuel pump, wherein at a time of starting of said engine, driving of said high-pressure fuel pump or an assist to drive torque for said high-pressure fuel pump is performed by said auxiliary power unit, and a sensor for detecting an action to be performed by a driver before said engine is started up, wherein based on a detection signal from said sensor, said high-pressure fuel pump is driven by said auxiliary power means prior to starting of said engine, wherein when a starter switch of said internal combustion engine is not turned on even after a predetermined time has elapsed from input of said detection signal from said sensor for detecting said action by said driver, said driving of said high-pressure fuel pump by said auxiliary power unit is stopped, and wherein when said starter switch is turned on after a predetermined time has elapsed from said input of said detection signal from said sensor for detecting said action by said driver, said high-pressure fuel pump is driven by a camshaft, and said high-pressure fuel pump is also driven by said auxiliary power unit.

6. The fuel supply system according to claim 5, wherein said engine is used for a vehicle such as an automobile, and said sensor for detecting said action by said driver is any one of a door lock release sensor for detecting a release of a door lock of said vehicle, a door open/close sensor for detecting opening and closing of a door of said vehicle and a seating sensor for detecting seating of said driver on an driver's seat of said vehicle.

7. A fuel supply system according to claim 5, wherein said driving of said high-pressure fuel pump by said auxiliary power unit after said starter switch is turned on is performed only at a cold start that said engine has not reached predetermined warming up conditions, and at a time point that said warming up conditions have reached said predetermined warming up conditions, said driving of said high-pressure fuel pump by said auxiliary power unit is stopped.

* * * * *